US006302295B1

(12) United States Patent
Weisman

(10) Patent No.: US 6,302,295 B1
(45) Date of Patent: Oct. 16, 2001

(54) PRESCRIPTION CAP WITH TRANSPARENT DAILY DOSAGE COMPARTMENT

(76) Inventor: Billy L. Weisman, 3727 Glenwood Springs, Kingwood, TX (US) 77345

( * ) Notice: Subject to any disclaimer, the term of this patent is extended or adjusted under 35 U.S.C. 154(b) by 0 days.

(21) Appl. No.: 09/517,118

(22) Filed: Mar. 7, 2000

(51) Int. Cl.[7] ..... A24F 15/04
(52) U.S. Cl. ..... 221/188; 221/288
(58) Field of Search ..... 221/288, 186, 221/188, 96, 286, 268, 266, 264; 222/425, 450, 454, 456; 206/540, 538

(56) References Cited

U.S. PATENT DOCUMENTS 3,601,250 * 8/1971 Merila ..... 221/188
4,047,635 9/1977 Bennett, Jr. .
4,573,580 3/1986 Messer .
4,753,189 6/1988 Mastman et al. .
5,011,032 4/1991 Rollman .

* cited by examiner

*Primary Examiner*—Kenneth W. Noland
(74) *Attorney, Agent, or Firm*—Randal D. Homburg

(57) ABSTRACT

The invention is a replacement cap applied to pill medication bottles having a transparent hollow storage compartment on the top of such lid, into which a daily dosage of the medicine is placed, enabling the user to visually determine whether the daily dosage of medication has been taken.

3 Claims, 2 Drawing Sheets

PRESCRIPTION CAP WITH TRANSPARENT DAILY DOSAGE COMPARTMENT

CROSS REFERENCE TO RELATED APPLICATIONS

None.

I. BACKGROUND OF INVENTION

1. Field of the Invention

The invention is a cap applied to pill medication bottles having a transparent hollow storage compartment on the top of such lid, into which a daily dosage of the medicine is placed, enabling the user to visually determine whether the daily dosage of medication has been taken.

2. Description of Prior Art

The following United States patents are disclosed herein and incorporated into this application for utility patent. All relate to prescription lids and caps, or to daily dosage devices for prescription medication. In U.S. Pat. No. 5,011,032 to Rollman, a color coded, dosage indicating, flip top, single pill dispensing lid is provided for persons having a disability with vision or dexterity. A prescription pill bottle lid having an automatic means of indicating dosage by display is disclosed in U.S. Pat. No. 4,753,189 to Mastman, which keeps track of pills taken whenever the cap is rotatably removed.

A unit dose medication dispenser is disclosed in U.S. Pat. No. 4,573,580 to Messer, providing a multiple compartment storage container for pills which is pre-filled at the beginning of the week or month providing daily dosages of a variety of medications. In U.S. Pat. No. 4,047,635 to Bennett, Jr., an apparatus containing multiple magazines containing pills is provided which, by automated means, dispenses pills and keeps count of the number of pills dispensed by the apparatus.

II. SUMMARY OF THE INVENTION

The primary objective of the invention is to provide a lid applied to pill prescription bottles having a visible means of keeping track of daily dosages of medication. A secondary objective of the invention is to provide a means of segregating a daily dosage of pill medication from the remaining pill supply in the bottle to reduce the risk of over or under medication by a user of such prescription medication.

III. DESCRIPTION OF THE DRAWINGS

The following drawings are submitted with this utility patent application.

IV. DESCRIPTION OF THE PREFERRED EMBODIMENT

Figure 1:
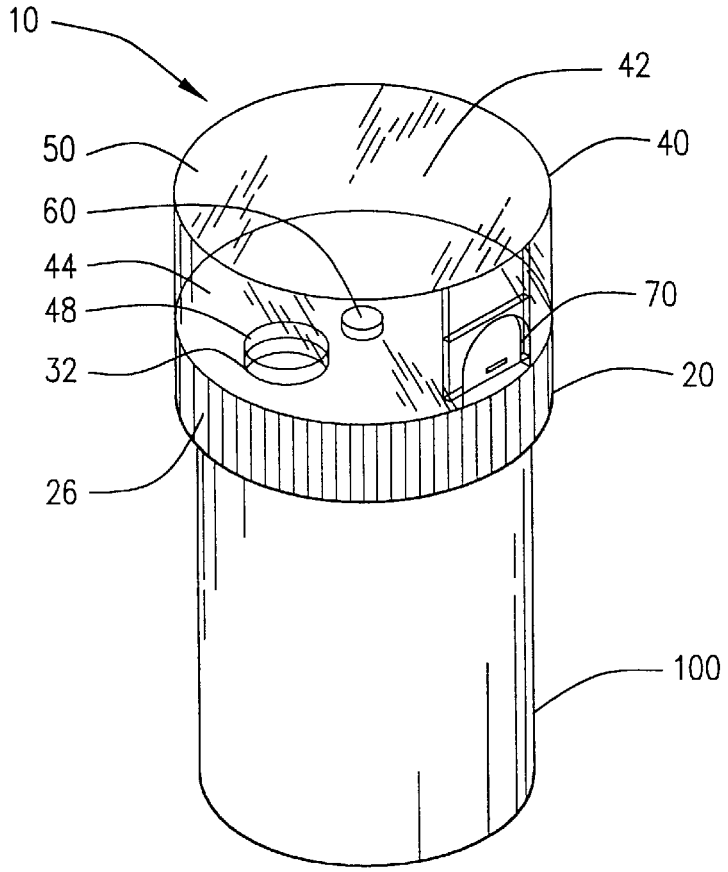
FIG. 1 is a perspective view of the invention applied to a bottle.
Figure 2:
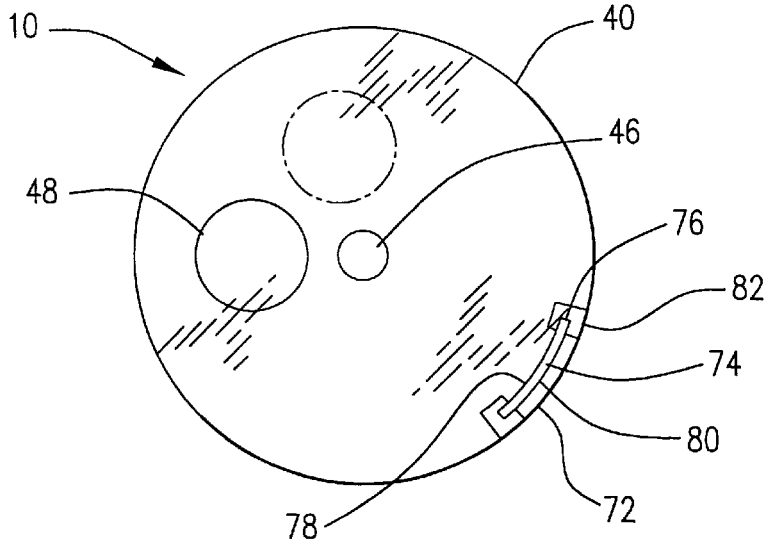
FIG. 2 is a top view of the invention.
Figure 3:
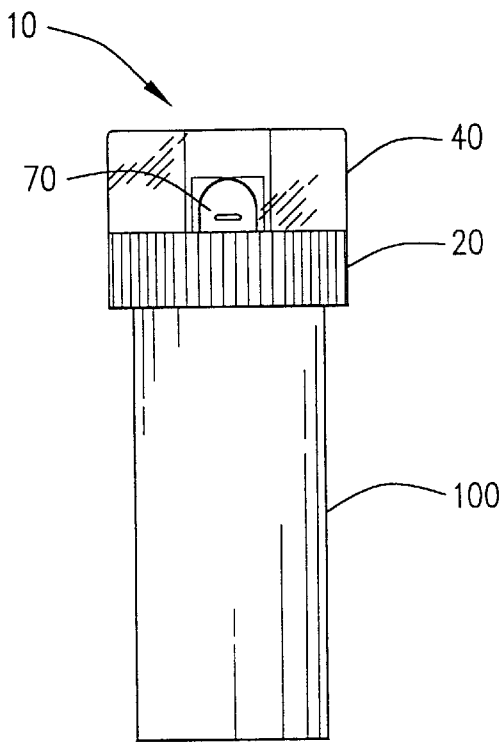
FIG. 3 is a side view of the invention attached to a bottle, showing the transparent upper portion and the dispensing opening.
Figure 4:
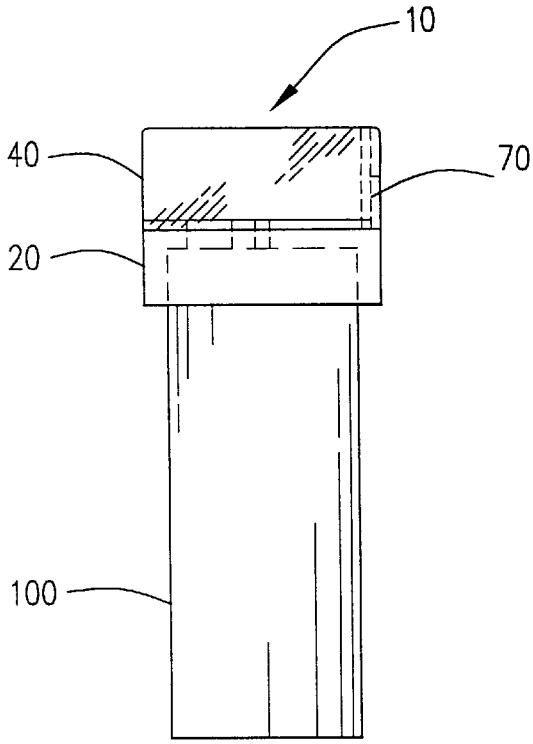
FIG. 4 is a second side view of the invention attached to a bottle.
Figure 5:
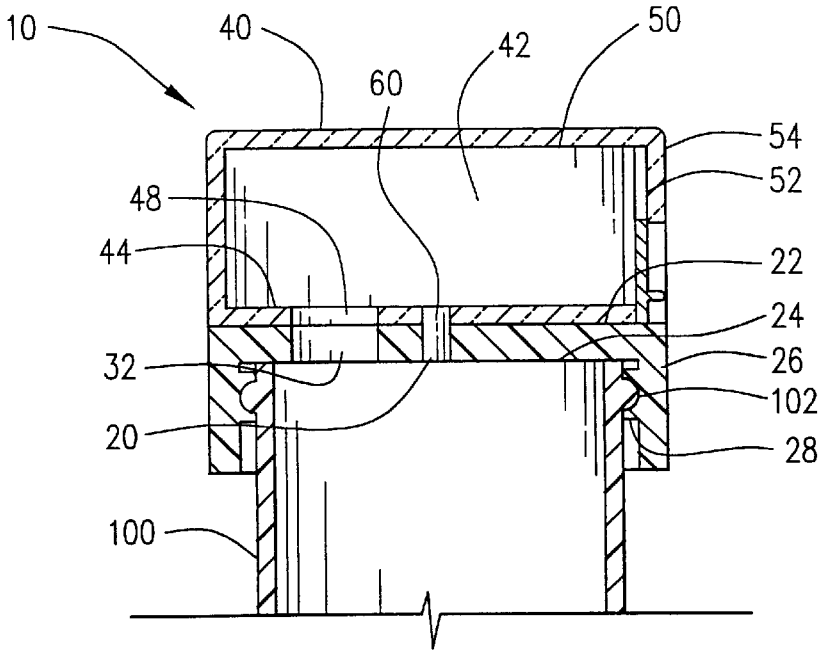
FIG. 5 is a partial cross-sectional side view of the invention applied to a bottle.

The invention, as shown in FIGS. 1–5 of the drawings, is a prescription cap with a transparent daily dosage compartment 10 comprising a transparent hollow storage compartment 40 and a lower bottle attaching portion 20. The lower bottle attaching portion 20 has an overall configuration which replaces a standard pill prescription bottle cap, having a circular shape and comprising an upper surface 22, a lower surface 24, a cylindrical threaded part 26 with an inner thread 28 to be engaged with the outer thread 102 of a prescription bottle 100, a central rivet hole 30 and an inner dispensing hole 32 between the upper surface 22 and the lower surface 24 of sufficient size to allow the passage of a prescription pill.

The transparent hollow storage compartment 40 is of similar shape as the lower bottle attaching portion 20, also having a circular shape, but comprising a hollow cylindrical cavity 42 having a bottom 44, a top 46, an inner peripheral edge 48 and an outer peripheral edge 50. The hollow cylindrical cavity 42 is of sufficient size to accommodate a daily dosage of prescription pills. The bottom 44 of the transparent hollow storage compartment 40 has a central rivet hole 46, and an inner dispensing hole 48, the central rivet hole 46 of the transparent hollow storage compartment 40 being in alignment with the central rivet hole 30 in the lower bottle attaching portion 20 and the inner dispensing hole 48 of the transparent hollow storage compartment 40 being in alignment with the inner dispensing hole 32 in the lower bottle attaching portion 20. A rivet 60 is inserted in the aligned central rivet hole 46 of the transparent hollow storage compartment 40 and the central rivet hole 30 of the lower bottle attaching portion 20, wherein the transparent hollow storage compartment 40 and the lower bottle attaching portion 20 are rotatably connected.

When turned in a particular alignment, the inner dispensing hole 48 of the of the transparent hollow storage compartment 40 and the inner dispensing hole 32 of the lower bottle attaching portion 20 are in alignment, wherein a pill on the inside of the bottle 100 to which the invention is applied may be poured from the bottle 100 into the hollow cylindrical cavity 42 of the transparent hollow storage compartment 40. These inner dispensing holes 32, 48 are not claimed as a particular shape, but the preferred embodiment would be a pie-shaped opening, to allow passage of several shaped pills.

Located in the transparent hollow storage compartment 40 of the invention is a closable outer dispensing means 70. In a preferred embodiment, as disclosed in FIG. 2 of the drawings, this closable outer dispensing means 70 is a sliding gate opening 72 located between the inner peripheral edge 52 and the outer peripheral edge 54 of the transparent hollow storage compartment 40, comprising a slidable gate hatch 74, having two sides 76, an inner surface 78, an outer surface 80 and a slidable gate hatch track 82, engaging the two sides 76 of the slidable gate hatch 74 and in contact with the inner surface 78 and the outer surface 80 of the slidable gate hatch 74 wherein the slidable gate hatch 74 may be raise or lowered, or move forwards or backwards, to open and close the sliding gate opening 72, giving the user access to pills within the hollow cylindrical cavity 42 to dispense such pills for later scheduled consumption. The slidable gate hatch track 82 engages the slidable gate hatch 74 in such a manner as to require a slight degree of force to move the slidable gate hatch 74 to open or close such ridable gate hatch 74. Alternatively, the closable outer dispensing means 70 may be place in the top 46 of the hollow storage compartment 40.

The utility of this invention therein provides the user with the ability to dispense from the prescription bottle 100 the daily dosage of the prescription pill into the transparent hollow storage compartment 40 at the start of the day, close off access to the prescription bottle 100, and thereafter visually monitor the number of prescription pills remaining in the hollow cylindrical cavity 42 of the transparent hollow storage compartment 40 to insure that the user has taken the prescribed dosage of prescription pills throughout the day.

While the invention has been particularly shown and described with reference to a preferred embodiment thereof, it will be understood by those skilled in the art that changes in form and detail may be made therein without departing from the spirit and scope of the invention.

What is claimed is:

1. A medicine pill bottle cap with a transparent hollow storage compartment to replace a standard medicine pill bottle cap, comprising:

a. a circular shaped lower bottle attaching portion having an upper surface, a lower surface, a cylindrical threaded part with an inner thread to be engaged with the outer thread of a prescription bottle to which the lower bottle attaching portion is to be attached, a central rivet hole and an inner dispensing hole between the upper surface and the lower surface;

b. a transparent hollow storage compartment of a similar shape as the lower bottle attaching portion having a hollow cylindrical cavity defining a bottom, a top, an inner peripheral edge and an outer peripheral edge, and a closable outer dispensing means, the bottom of the transparent hollow storage compartment further defining an inner dispensing hole, and a central rivet hole;

c. a rivet placed within the central rivet hole of the lower bottle attaching portion and the central rivet hole of the transparent hollow storage compartment securing the lower bottle attaching portion to the transparent hollow storage compartment in a rotatable manner, wherein the inner dispensing hole of the lower bottle attaching portion may be aligned with the inner dispensing hole of the transparent hollow storage compartment allowing a daily dosage of pills within the bottle to which the lower bottle attaching portion is attached to enter the hollow cylindrical cavity of the transparent hollow storage compartment for visible monitoring by the user.

2. The invention, as disclosed in claim 1, the closable outer dispensing means further comprising:

a. a sliding gate opening between the inner peripheral edge and the outer peripheral edge of the hollow cylindrical cavity of the transparent hollow storage compartment;

b. a slidable gate hatch, having two sides, an inner surface and an outer surface;

c. a slidable gate hatch track engaging the two sides of the slidable gate hatch and in contact with the inner surface and the outer surface of the slidable gate hatch, wherein the slidable gate hatch may be raised or lowered, opening or closing the sliding gate opening, giving the user access to pills contained within the hollow cylindrical cavity of the transparent hollow storage compartment.

3. The invention, as disclosed in claim 1, the closable outer dispensing means further comprising:

a. a sliding gate opening in the top of the hollow cylindrical cavity of the transparent hollow storage compartment;

b. a slidable gate hatch, having two sides, an inner surface and an outer surface;

c. a slidable gate hatch track engaging the two sides of the slidable gate hatch and in contact with the inner surface and the outer surface of the slidable gate hatch, wherein the slidable gate hatch may be slid forward or backwards, opening or closing the sliding gate opening, giving the user access to pills contained within the hollow cylindrical cavity of the transparent hollow storage compartment.

* * * * *